US006941674B2

(12) United States Patent
Park et al.

(10) Patent No.: US 6,941,674 B2
(45) Date of Patent: Sep. 13, 2005

(54) METHOD AND APPARATUS FOR DETECTING RESIDUAL DRYING TIME OF CLOTHES DRYER

(75) Inventors: Dae-Yun Park, Gwangmyeong (KR); Kyung-Seop Hong, Incheon (KR); Young-Hwan Park, Seoul (KR); In-Cheol Jeong, Goyang (KR); Soo-Young Oh, Seoul (KR); Si-Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/743,495

(22) Filed: Dec. 23, 2003

(65) Prior Publication Data

US 2005/0050763 A1 Mar. 10, 2005

(30) Foreign Application Priority Data

Aug. 12, 2003 (KR) ..... 10-2003-0055846

(51) Int. Cl.[7] ..... F26B 19/00
(52) U.S. Cl. ..... 34/88; 34/557; 34/562
(58) Field of Search ..... 34/528, 595, 476, 34/493, 562, 88, 557

(56) References Cited

U.S. PATENT DOCUMENTS

| | | | | | |
|---|---|---|---|---|---|
| 4,531,305 | A | * | 7/1985 | Nagayasu et al. | 34/445 |
| 4,738,034 | A | * | 4/1988 | Muramatsu et al. | 34/524 |
| 5,291,667 | A | * | 3/1994 | Joslin et al. | 34/526 |
| 6,047,486 | A | * | 4/2000 | Reck et al. | 34/491 |
| 6,122,840 | A | * | 9/2000 | Chbat et al. | 34/496 |
| 6,446,357 | B2 | * | 9/2002 | Woerdehoff et al. | 34/491 |
| 6,449,876 | B1 | | 9/2002 | Pursell | |

FOREIGN PATENT DOCUMENTS

| | | |
|---|---|---|
| DE | 199 39 271 A1 | 2/2001 |
| DE | 199 39 273 A1 | 2/2001 |
| EP | 0 039 645 A1 | 11/1981 |
| EP | 1 048 996 A1 | 11/2000 |

* cited by examiner

*Primary Examiner*—Cheryl Tyler
*Assistant Examiner*—Kathryn S. O'Malley
(74) *Attorney, Agent, or Firm*—Birch, Stewart, Kolasch & Birch, LLP

(57) ABSTRACT

In a method and an apparatus for detecting a residual drying time of a clothes dryer, by detecting a quantity of moisture contained in clothes in a clothes dryer and displaying a residual clothes drying time on the basis of the detected moisture quantity, a residual clothes drying time can be displayed accurately.

4 Claims, 5 Drawing Sheets

METHOD AND APPARATUS FOR DETECTING RESIDUAL DRYING TIME OF CLOTHES DRYER

This Nonprovisional application claims priority under 35 U.S.C. § 119(a) on Patent Application No(s). 10-2003-0055846 filed in Korea on Aug. 12, 2003, the entire contents of which are hereby incorporated by reference.

BACKGROUND OF THE INVENTION

1. Field of the Invention

The present invention relates to a clothes dryer, and in particular to a method and an apparatus for detecting a residual drying time of a clothes dryer.

2. Description of the Related Art

In general, a clothes dryer rotates clothes in a drum by rotating the drum and generates heat by using a heater, and low temperature-little moisture air is converted into high temperature-little moisture air while passing the heater according to rotation of a drying fan.

The clothes dryer heats the clothes by making the high temperature-little moisture air flow into the drum. Herein, the high temperature-little moisture air is converted into high temperature-much moisture air by steam generated while the clothes are heated. The high temperature-much moisture air is converted into low temperature-little moisture air by being condensed by an internal condenser, and it is converted into high temperature-little moisture air while passing the heater according to the rotation of the drying fan. In more detail, the clothes dryer dries clothes in the drum by performing the clothes heating process repeatedly. In addition, when clothes drying is finished, the clothes dryer stops the operation of the heater and cools the dried clothes by operating only a motor in order to make a user take out the clothes easily. Herein, a time required for heating clothes in the drum of the clothes dryer and cooling the clothes thereafter is called a clothes drying time.

In addition, in the conventional clothes dryer, in order to display a residual drying time, a drying time and a cooling time are preset, the set drying time is reduced in drying with the passage of time, and the set cooling time is reduced in cooling with the passage of time.

In the meantime, detailed description about the clothes dryer was disclosed in U.S. Pat. No. 6,449,876.

However, in the conventional clothes dryer, because a preset residual drying time is displayed regardless of a quantity of moisture contained in clothes in the drum of the clothes dryer, there may be error between an actual residual drying time and a displayed residual drying time, and accordingly reliability of the clothes dryer may be lowered due to that error.

SUMMARY OF THE INVENTION

In order to solve the above-mentioned problem, it is an object of the present invention to provide a method and an apparatus for detecting a residual drying time of a clothes dryer capable of displaying a residual drying time accurately by detecting a quantity of moisture contained in clothes in a drum of a clothes dryer and displaying a residual drying time according to the detected quantity of moisture.

It is another object of the present invention to provide a method and an apparatus for detecting a residual drying time of a clothes dryer capable of displaying a residual drying time accurately by displaying a residual displaying time on the basis of a quantity of moisture contained in clothes in a drum of a clothes dryer and an outlet temperature value of the drum of the clothes dryer.

In order to achieve the above-mentioned objects, a method for detecting a residual drying time of a clothes dryer in accordance with the present invention includes detecting a quantity of moisture contained in clothes in a clothes dryer; and displaying a residual clothes drying time on the basis of the detected moisture quantity.

In order to achieve the above-mentioned objects, a method for detecting a residual drying time of a clothes dryer in accordance with the present invention includes reducing a preset early clothes drying time in early operation of a clothes dryer with the passage of time and displaying the reduced time on a display in real-time; detecting a quantity of moisture contained in clothes in a drum of the clothes dryer and an outlet temperature of the drum; reading a residual clothes drying time corresponded to the detected moisture quantity and temperature value from a memory storing a residual drying time pre-calculated on the basis of the moisture quantity and outlet temperature value of the drum; and displaying the read residual drying time in real-time; wherein the residual drying time includes an estimated drying time and an estimated cooling time.

In order to achieve the above-mentioned objects, an apparatus for detecting a residual drying time of a clothes dryer in accordance with the present invention includes a means for detecting a quantity of moisture contained in clothes in a clothes dryer; and a means for displaying a residual clothes drying time on the basis of the detected moisture quantity.

In order to achieve the above-mentioned objects, an apparatus for detecting a residual drying time of a clothes dryer in accordance with the present invention includes a moisture detector for detecting a quantity of moisture contained in clothes in clothes dryer; a temperature detector for detecting an outlet temperature of a drum of the clothes dryer; a controller for reading a residual drying time corresponded to the moisture quantity and the outlet temperature value of the drum from a storage storing a pre-calculated residual drying time on the basis of the moisture quantity and the outlet temperature value of the drum; and a display for displaying the read residual drying time according to the control signal of the controller.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiment of a method and an apparatus for detecting a residual drying time of a clothes dryer capable of displaying a residual drying time accurately by displaying a residual displaying time on the basis of a quantity of moisture contained in clothes in a drum of a clothes dryer and/or an outlet temperature value of the drum of the clothes dryer will be described with reference to FIGS. 1~7.

Figure 1:
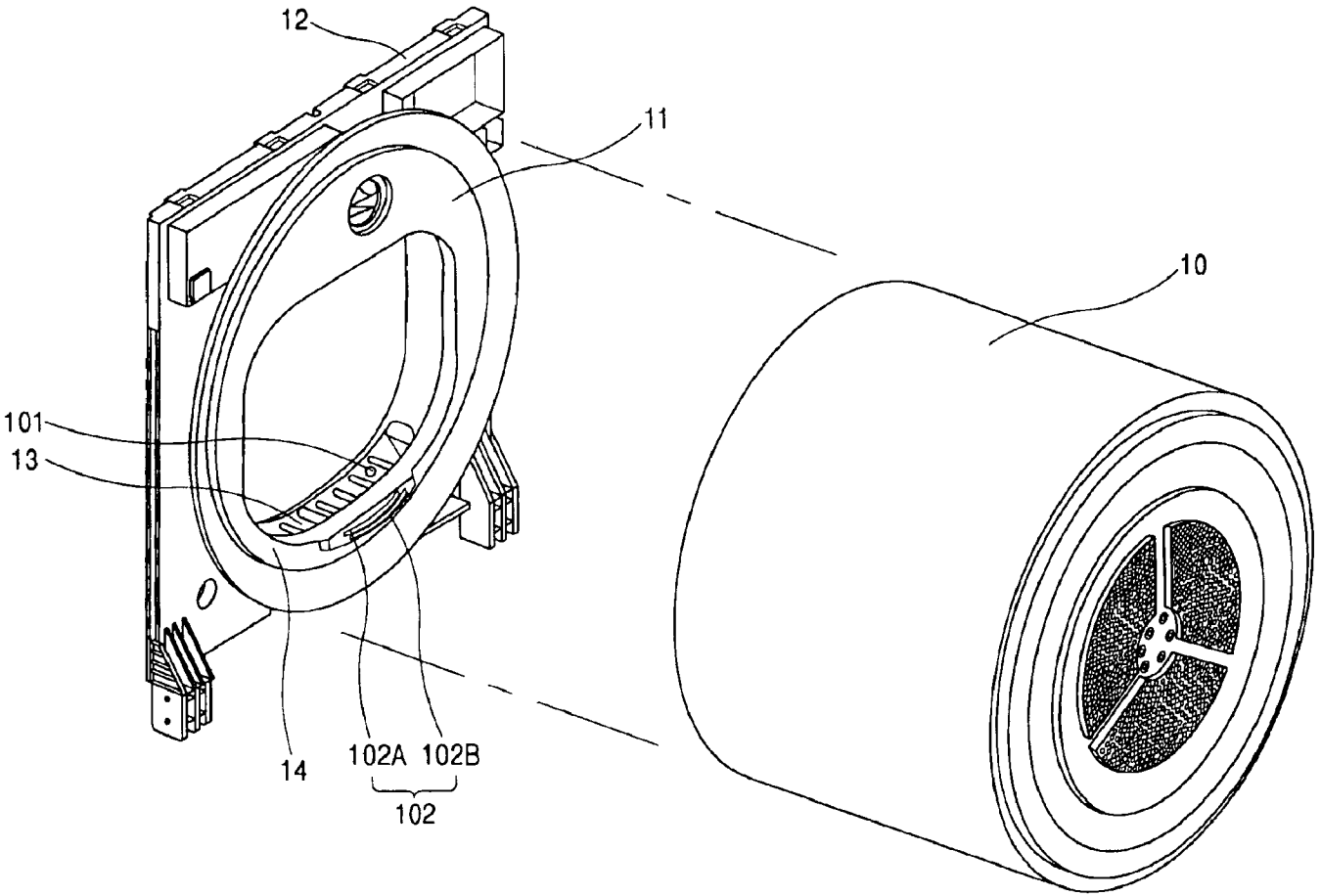
FIG. 1 is a schematic-perspective view illustrating a structure of a clothes dryer having a residual drying time detecting apparatus in accordance with an embodiment of the present invention.

FIG. 1 is a schematic-perspective view illustrating a structure of a clothes dryer having a residual drying time detecting apparatus in accordance with an embodiment of the present invention.

As depicted in FIG. 1, the clothes dryer includes a drum 10 for receiving and drying clothes; a door 12 installed on the front of the drum 10 so as to be open/closed; a drum cover 11 installed in the door 12 so as to be arranged on the front of the drum 10 when a sub-door 13 is closed; a moisture detector 102 having a pair of electrodes 102*a*, 102B installed on a slant surface 14 formed at the front lower end of the drum cover 11; and a temperature detector 101 installed in an air channel 13 for receiving high temperature-much moisture air such as steam generated in drying of clothes in the drum 10 in order to detect a temperature of the high temperature-much moisture air discharged from the drum 10. In more detail, in the clothes dryer, by operating a heater (not shown) and a motor (not shown), the drum 10 is rotated, and heat energy generated in the heater is transmitted into the drum 10. Herein, air discharged from the drum 10 while the clothes are heated and dried flows into the air channel 13 and is circulated.

Hereinafter, the operation of the moisture detector 102 and the temperature detector 101 of the apparatus for detecting the residual drying time of the clothes dryer in accordance with the embodiment of the present invention will be described.

Figure 2:
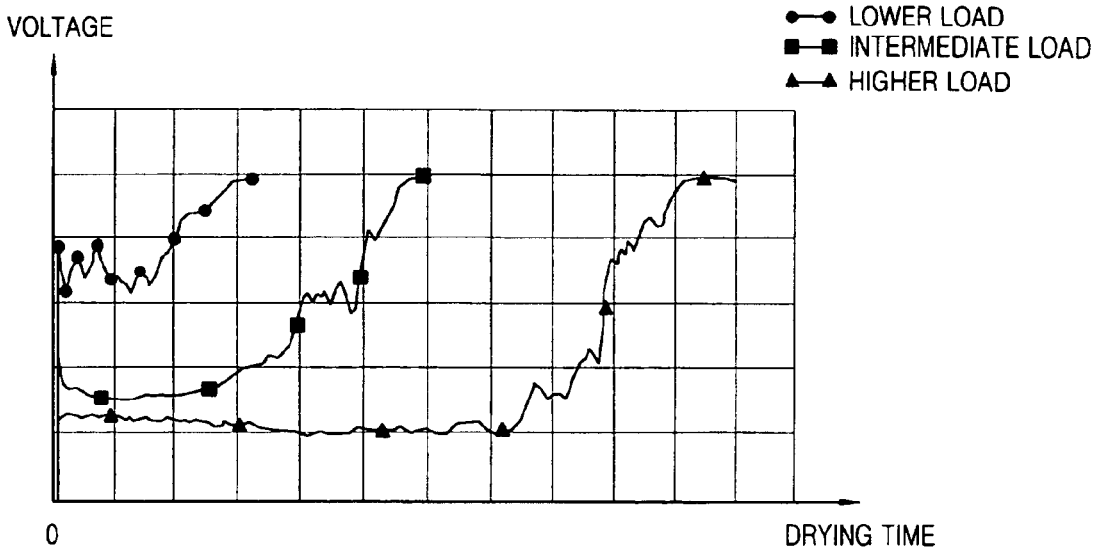
FIG. 2 is a graph showing level variation of a moisture detecting voltage according to a load of the clothes dryer detected in clothes drying by a moisture detector.

FIG. 2 is a graph showing level variation of a moisture detecting voltage according to a load of the clothes dryer detected in clothes drying by the moisture detector 102. Herein, the load means a quantity of moisture of the clothes in the drum of the clothes dryer.

The pair of electrodes 102A, 102B of the moisture detector 102 are contacted with the clothes rotated according to the rotation of the drum 10. Herein, a both ends resistance value of the pair of the electrodes 102A, 102B is varied according to a quantity of moisture contained in the clothes in the drum 10. For example, when a quantity of moisture contained in the clothes in the drum 10 is increased, a both ends resistance value of the electrodes 102A, 102B is decreased, when a quantity of moisture contained in the clothes in the drum 10 is decreased, a both ends resistance value of the electrodes 102A, 102B is increased. Accordingly, a both ends resistance value of the electrodes 102A, 102B of the moisture detector 102 is in inverse proportion to a quantity of moisture contained in the clothes in the drum 10.

In addition, the moisture detector 102 converts a both ends resistance value of the electrodes 102A, 102B into a moisture detecting voltage and outputs the converted moisture detecting voltage to a controller 103. Herein, in test results, in case of performing the clothes drying process, as depicted in FIG. 2, the moisture detecting voltage is different according to a load (quantity of moisture contained in the clothes). In more detail, the lower the load, the higher a moisture detecting voltage is detected, the higher the load, the lower a moisture detecting voltage is detected.

Figure 3:
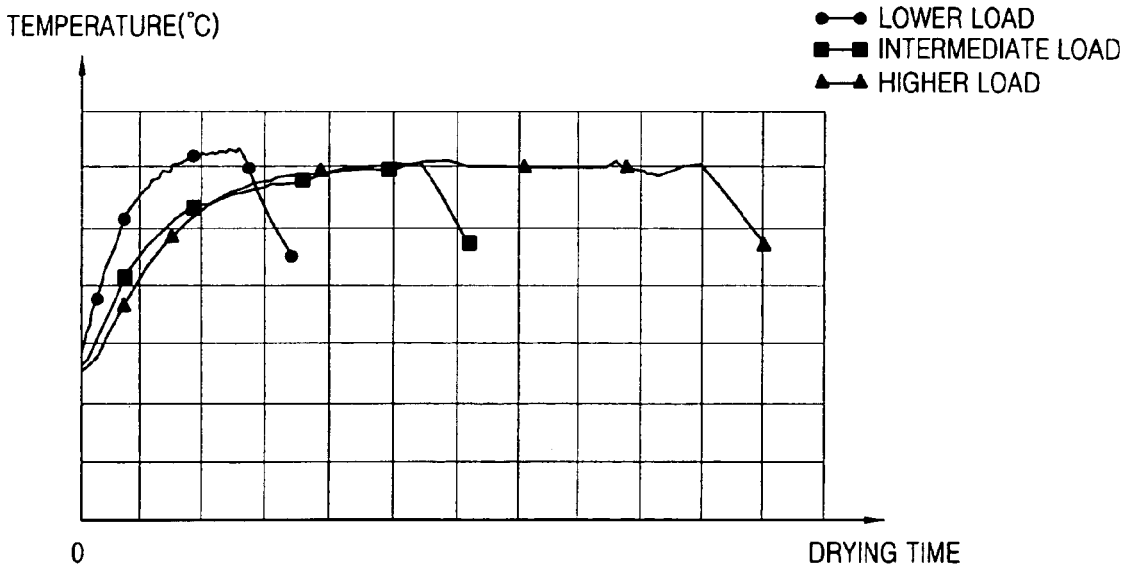
FIG. 3 is a graph showing outlet temperature variation of a drum according to a load of the clothes dryer detected in clothes drying by a temperature detector.

FIG. 3 is a graph showing outlet temperature variation of a drum according to a load of the clothes dryer detected in clothes drying by the temperature detector 101.

The temperature detector 101 detects a temperature of the air discharged from the drum 10 into the air channel 13. Herein, as depicted in FIG. 3, the detected temperature is different according to a load. In more detail, the lower the load, the higher a temperature is detected, the higher the load, the lower a temperature is detected.

Hereinafter, a method and an apparatus for detecting a residual drying time of a clothes dryer capable of detecting a quantity of moisture (load) contained in clothes accurately on the basis of a moisture detecting voltage value detected by the moisture detector 102 and a drum outlet temperature value detected by the temperature detector 101 and displaying a residual drying time according to the detected quantity of moisture (load) will be described with reference to FIGS. 4~7.

Figure 4:
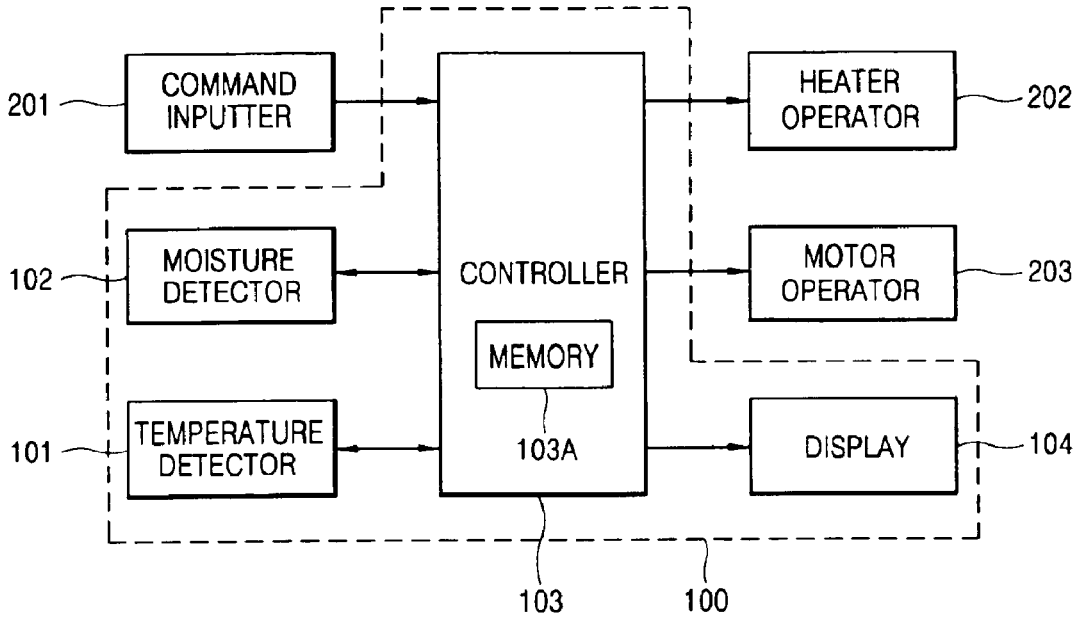
FIG. 4 is a block diagram illustrating a residual drying time detecting apparatus for a clothes dryer in accordance with an embodiment of the present invention.

FIG. 4 is a block diagram illustrating a control apparatus having a residual drying time detecting unit for a clothes dryer in accordance with the embodiment of the present invention.

As depicted in FIG. 4, the control unit of the clothes dryer includes a command inputter 201 for inputting an operation command according to operation of a user; a heater operator 202 for operating a heater of the clothes dryer according to a control signal; a motor operator 203 for operating a motor of the clothes dryer according to a control signal; and a residual drying time detecting unit 100 for displaying a residual drying time of the clothes dryer on the basis of a quantity of moisture contained in the clothes in the drum 10 of the clothes dryer and/or a drum output temperature.

The residual drying time detecting unit 100 includes the moisture detector 102 for detecting a quantity of moisture contained in the clothes in the drum 10 of the clothes dryer; the temperature detector 101 for detecting an outlet temperature of the drum 10; the controller 103 for reading a residual drying time corresponded to the moisture quantity and the outlet temperature value of the drum 10 from a memory 103A storing a pre-calculated residual drying time on the basis of the moisture quantity and the outlet temperature value of the drum 10; and a display 104 for displaying the read residual drying time according to the control signal of the controller 103. Herein, a first look-up table showing an estimated drying time pre-calculated according to the moisture quantity and the outlet temperature value of the drum 10 and a second look-up table showing an estimated cooling time pre-calculated according to the moisture quantity and the outlet temperature value of the drum 10 are pre-stored in the memory 103A. In addition, when a drying command is received from the command inputter 201, the controller 103 reads a quantity of moisture contained in the clothes in the drum 10 of the clothes dryer on the basis of a moisture quantity value of the moisture detector 102 and a temperature value of the temperature detector 101 while controlling the clothes drying operation, reads a residual drying time from the first and second look-up tables according to the detected moisture quantity and transmits the read residual drying time value to the display 104.

Hereinafter, a method for detecting a residual drying time in accordance with the present invention will be described with reference to FIG. 5.

Figure 5:
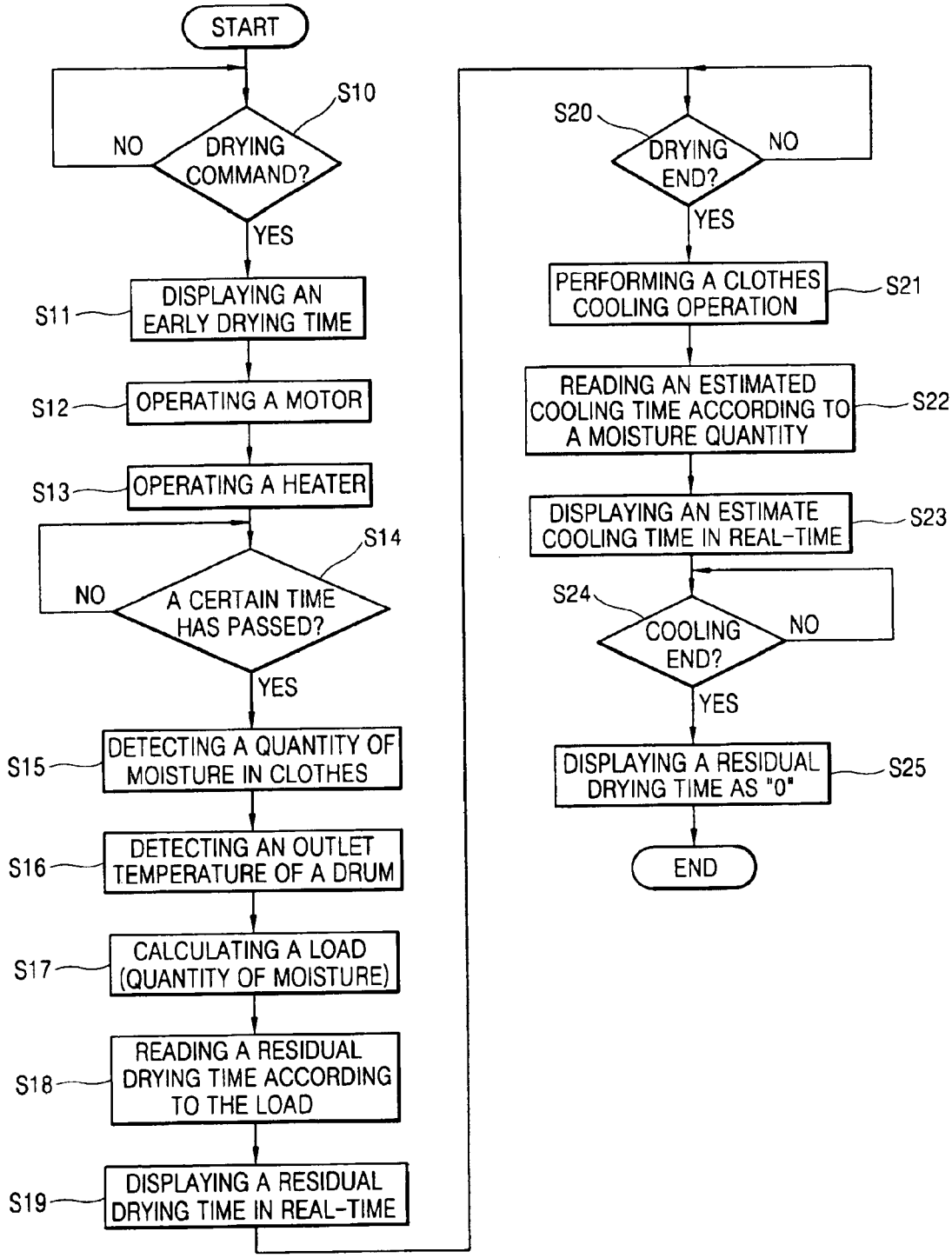
FIG. 5 is a flow chart illustrating a residual drying time detecting method for a clothes dryer in accordance with an embodiment of the present invention.

FIG. 5 is a flow chart illustrating a residual drying time detecting method in accordance with an embodiment of the present invention.

First, when the user puts clothes to be dried into the drum 10 and commands drying by operating the command inputter 201 as shown at step S10, the controller 103 displays a preset early clothes drying time on the display 104. In addition, the controller 103 reduces the early drying time with the passage of time and displays a reduced time on the display 104 as shown at step S11.

The motor operator 203 operates the motor according to a control signal from the controller 103 as shown at step S12, and the heater operator 202 operates the heater according to a control signal from the controller 103 as shown at step S13. Accordingly, by the rotational force of the motor, the drum 10 is rotated, heat energy generated by the heater is transmitted into the drum 10, air discharged from the drum 10 flows into the air channel 13 and is circulated.

Afterward, the controller 103 judges whether a preset detecting time (for example, 5 minutes) has passed as shown at step S14, when the present time has passed, it generates a moisture detecting signal and a temperature detecting signal, outputs the moisture detecting signal to the moisture detector 102 and outputs the temperature detecting signal to the temperature detector 101.

When the pair of electrodes 102A, 102B are contacted with the clothes rotated in the drum 10 according to the rotation of the drum 10, the moisture detector 102 detects a both end resistance value of the electrodes 102A, 102B varied according to a moisture quantity of the clothes on the basis of the moisture detecting signal, obtains a moisture detecting voltage by multiplying the detected resistance value by an input current value and outputs it to the controller 103. Herein, the moisture detector 102 can output the resistance value to the controller 103, and the controller 103 can detect a quantity of moisture contained in the clothes in the drum 10 on the basis of the resistance value as shown at step S15.

The temperature detector 101 detects an outlet temperature of the drum 10 on the basis of the temperature detecting signal and outputs the detected temperature value to the controller 103 as shown at step S16. Herein, the outlet temperature of the drum 10 will be described with reference to FIGS. 6 and 7.

Figure 6:
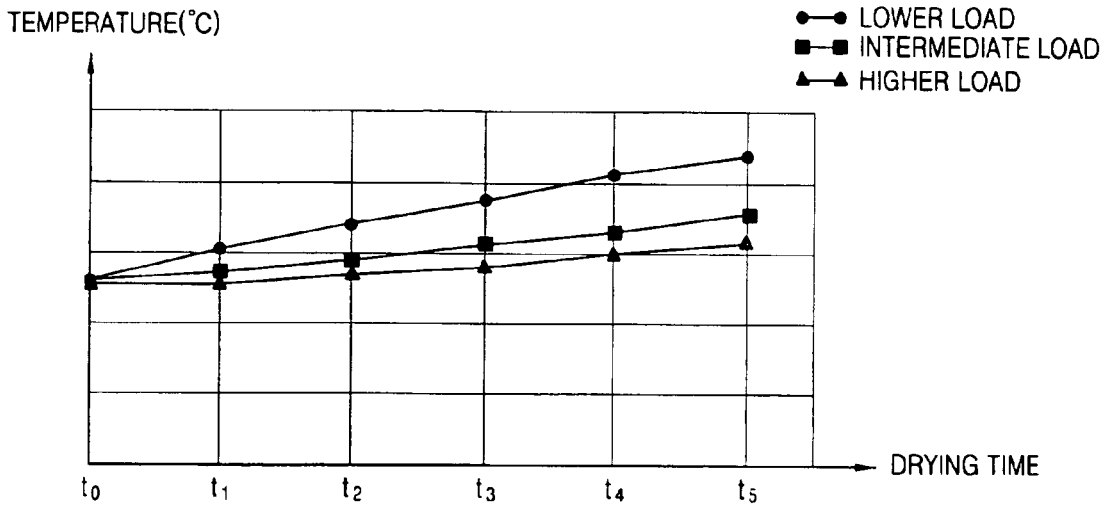
FIG. 6 is a graph showing outlet temperature variation of a drum detected by a temperature detector in early clothes drying in accordance with the present residual drying time detecting method.
Figure 7:
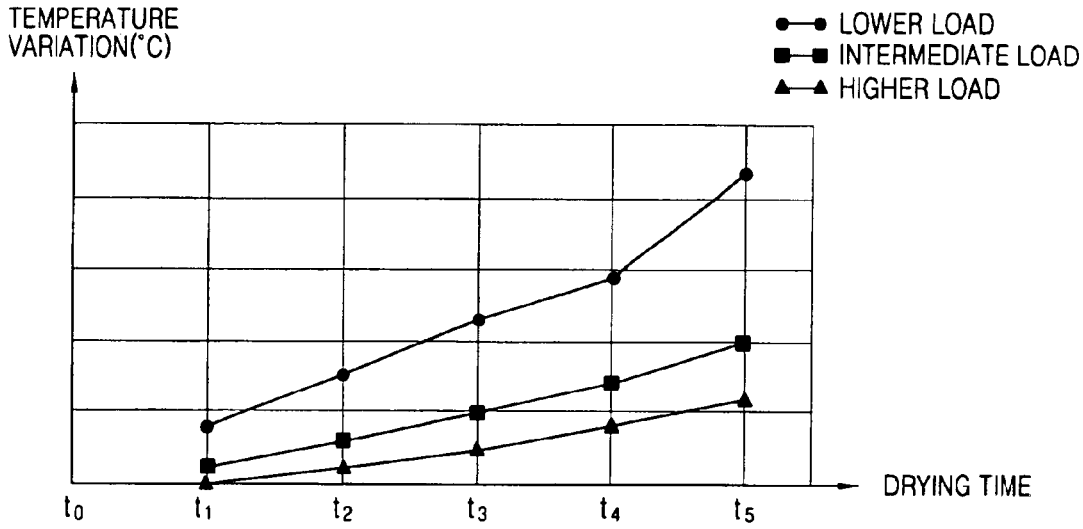
FIG. 7 is a graph showing outlet temperature variation of a drum per unit time detected by the temperature detector in early clothes drying in accordance with the present residual drying time detecting method.

FIG. 6 is a graph showing outlet temperature variation of the drum detected by the temperature detector 101 in early clothes drying in accordance with the present residual drying time detecting method, and FIG. 7 is a graph showing outlet temperature variation of the drum per unit time (Δ T) detected by the temperature detector 101 in early clothes drying in accordance with the present residual drying time detecting method.

Afterward, the controller 103 calculates a load (quantity of moisture contained in the clothes) of the clothes dryer by assigning the moisture detecting voltage and the outlet temperature variation of the drum (Δ T) to Equation 1 as shown at step S17. Herein, the controller 103 can detect a quantity of moisture contained in the clothes in the drum 10 on the basis of only the moisture detecting voltage value, however, in order to detect a quantity of moisture accurately, it is preferable to detect a quantity of moisture on the basis of both the moisture detecting voltage value and the drum outlet temperature value (temperature variation (Δ T)).

$$TE=H(t1)\times\Delta T(t1) \qquad \text{Equation 1}$$

Herein, H(t1) is a level of a moisture detecting voltage for a time (t1), and Δ T(t1) is variation of a drum outlet temperature for a time (t1).

When the load (TE) is calculated, the controller 103 reads an estimated drying time according to the calculated load from the first look-up table in the memory 103A as shown at step S18 and displays the read estimated drying time on the display 104. Herein, the controller 103 reduces the read estimated drying time with the passage of time and displays the reduced estimated drying time on the display 104 in real-time as shown at step S19.

Afterward, the controller 103 judges whether the clothes drying operation is finished as shown at step S20, when the drying operation is finished, it performs the clothes cooling operation as shown at step S21, reads an estimated cooling time according to the calculated load from the second look-up table in the memory 103A as shown at step S22 and displays the read estimated cooling time on the display 104. Herein, the controller 103 reduces the read estimated cooling time with the passage of time and displays the reduced estimated cooling time on the display 104 as shown at step S23.

The controller 103 judges whether the cooling is finished as shown at step S24, displays a residual drying time as '0' on the display 104 when the cooling is finished and finishes the clothes drying operation of the clothes dryer as shown at step S25.

As described-above, in the method and apparatus for displaying the residual drying time of the clothes dryer, by detecting a quantity of moisture (load) contained in clothes in the drum 10 accurately and displaying a residual clothes drying time accurately according to the detected moisture quantity, it is possible to display a residual drying time accurately without having error between an actual residual drying time and a residual drying time displayed on the display 104. Accordingly, reliability of the clothes dryer can be improved.

What is claimed is:

1. An apparatus for detecting a residual drying time of a clothes dryer, comprising:

a moisture detector for detecting a quantity of moisture contained in clothes in clothes dryer;

a temperature detector for detecting an outlet temperature of a drum of the clothes dryer;

a controller for reading a residual drying time corresponded to a sum of the moisture quantity and a variation of the outlet temperature value of the drum from a storage storing a pre-calculated residual drying time on the basis of the moisture quantity and the outlet temperature value of the drum; and a display for displaying the read residual drying time according to the control signal of the controller.

2. The apparatus of claim 1, wherein the storage includes a first look-up table showing an estimated drying time pre-calculated according to the moisture quantity and the outlet temperature value of the drum and a second look-up table showing an estimated cooling time pre-calculated according to the moisture quantity and the outlet temperature value of the drum.

3. The apparatus of claim 1, wherein the controller reduces the read residual drying time with the passage of time and displays the reduced time.

4. A method for detecting a residual drying time of a clothes dryer, comprising:

reducing a preset early clothes drying time in early operation of a clothes dryer with the passage of time and displaying the reduced time on a display in real-time;

detecting a quantity of moisture contained in clothes in a drum of the clothes dryer and an outlet temperature of the drum;

reading a residual clothes drying time corresponded to a sum of the detected moisture quantity and a variation in temperature value from a memory storing a residual drying time pre-calculated on the basis of the moisture quantity and outlet temperature value of the drum; and displaying the read residual drying time in real-time;

wherein the residual drying time includes an estimated drying time and an estimated cooling time.

* * * * *